US007025663B2

(12) United States Patent
Kim

(10) Patent No.: US 7,025,663 B2
(45) Date of Patent: Apr. 11, 2006

(54) CHEMICAL MECHANICAL POLISHING APPARATUS HAVING CONDITIONING CLEANING DEVICE

(75) Inventor: Tae-Bong Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/947,332

(22) Filed: Sep. 23, 2004

(65) Prior Publication Data

US 2005/0070215 A1 Mar. 31, 2005

(30) Foreign Application Priority Data

Sep. 25, 2003 (KR) ..... 10-2003-0066518

(51) Int. Cl.
*B24B 7/22* (2006.01)
*B24B 53/00* (2006.01)

(52) U.S. Cl. ..... 451/285; 451/444; 451/56

(58) Field of Classification Search ..... 451/444, 451/443, 56, 72, 67, 285, 287, 288
See application file for complete search history.

(56) References Cited

U.S. PATENT DOCUMENTS 4,433,639 A * 2/1984 Brown ..... 118/316
6,126,530 A * 10/2000 Hirata ..... 451/444
6,319,105 B1 * 11/2001 Togawa et al. ..... 451/287
6,358,124 B1 * 3/2002 Koga et al. ..... 451/56

* cited by examiner

*Primary Examiner*—Robert A. Rose
(74) *Attorney, Agent, or Firm*—Volentine Francos & Whitt PLLC

(57) ABSTRACT

A chemical mechanical polishing apparatus having a conditioning cleaning device capable of efficiently cleaning a diamond pad is disclosed. The conditioner cleaning device of the present invention is capable of increasing cleaning efficiency by uniformly spraying a cleaning solution on upper and side faces of a diamond disk. When the diamond disk is efficiently cleaned, the process reliability of a wafer is increased.

19 Claims, 5 Drawing Sheets

CHEMICAL MECHANICAL POLISHING APPARATUS HAVING CONDITIONING CLEANING DEVICE

CROSS REFERENCES TO RELATED APPLICATIONS

This application claims priority under 35 U.S.C. §119 to Korean Patent Application 2003-66518, filed on Sep. 25, 2003, the contents of which are hereby incorporated by reference in their entirety.

BACKGROUND OF THE INVENTION

1. Field of the Invention

The present invention relates to a chemical mechanical apparatus, and in particular to a conditioner cleaning device incorporating a chemical mechanical polishing pad. The conditioner cleaning device of the present invention is capable of increasing cleaning efficiency by uniformly spraying a cleaning solution on upper and side faces of a diamond disk. When the diamond disk is efficiently cleaned, the process reliability of a wafer is increased.

2. Description of the Related Art

In general, chemical mechanical polishing (CMP) is a technique that chemically and mechanically polishes the interlayer insulation layers typically formed on a wafer substrate during the fabrication of semiconductor devices. Interlayer insulation layers are used to cover wires in order to realize a satisfactory multiple wiring structure within the overall structure of a semiconductor device.

In order to fabricate a highly integrated semiconductor device having circuit lines with fine line width in a multi-stage layer, a high level polishing technique for surface planarizations is required. That is, in fabricating a densely-integrated semiconductor device there is a limitation to the use of mechanical surface polishing for ultra precision surfaces, i.e., below about 1 μm; thus, the CMP technique using both the chemical and mechanical polishing is currently used.

Recently, sub-micron processing below about 0.35 μm, requires a more detailed planarization technique to realize a fine pattern formation. In addition, continued development in the CMP technique is actively being sought and applied to next-generation semiconductor devices. The current CMP technique is often applied to logic-type devices requiring multiple layer wiring to realize high speed devices, but the use of multiple layer wiring in emerging memory devices has gradually increased.

The planarization of a wafer is performed in such a way that a non-polishing face of the wafer is held to a carrier head by vacuum pressure, and under this condition, a polishing face of the wafer is placed in contact with a polishing pad. While the polishing pad rotates, slurry is supplied between the polishing pad and the polishing face of the wafer.

In some additional detail, a CMP apparatus generally includes loadlock to load/unload a cassette, polishing unit, cleaning unit, and robot to transfer wafers therebetween.

As shown in FIG. 1, polishing unit for chemical mechanical polishing a wafer includes table 1, a plurality of platens (not shown), polishing pad 2, Head Cup Load Unload (HCLU) 3, and carrier (not shown). Polishing pad 2 is adapted to interlockingly operate on the upper face of platen. HCLU 3 is provided at a position where the wafer is loaded and unloaded by robot together with polishing pad 2. Polishing head 4, together with polishing pad 2, and HCLU 3 are each adapted to rotate on the upper portion of table 1.

While the wafer held to polishing head 4 is rotated with a uniform pressure in the same direction to one side of polishing pad 2, the wafer is polished mechanically by a friction force between polishing pad 2 and the wafer. Simultaneously, slurry is supplied onto an upper face of polishing pad 2 through slurry arm 5, which is provided at one end of polishing pad 2 to thereby planarize the wafer.

This polishing process requires continual maintenance of polishing pad 2. Thus, pad conditioner 6 is used to condition, i.e., maintain, the polishing pad.

As shown in FIG. 2 pad conditioner 6 is used to appropriately condition polishing pad 2 through the use of diamond disk 6*a* provided at one end thereof so as to even out the roughness of polishing pad's surface. Accordingly, a conditioning is applied to physically return polishing pad 2 to its original state. In this manner, the uniform surface level of polishing pad 2 is maintained, thereby maintaining a uniform pressure between polishing pad 2 and polishing head 4.

Unfortunately, some of the slurry used to chemically polish wafer W (shown in FIG. 2) may be absorbed onto the diamond disk 6*a* and solidified thereon. The solidified slurry may thereafter drop onto polishing pad 2, scratching its polishing face. A scratch on polishing pad 2 may damage the wafer being processed in the polishing apparatus. To prevent the generation of scratches and other damage to the wafer, cleaning device 7 adapted to clean diamond disk 6*a* is provided at a separate location wherein pad conditioner 6 may be cleaned.

As shown in FIG. 3, cleaning device 7 comprises cup housing 710 having a recess with a predetermined depth to form cleaning solution storing section 711. On cleaning solution storing section 711 an air bubble plate 720 is located therein. Cup housing 710 should have a diameter no smaller than the diameter of diamond disk 6*a*. Also, first nozzle 730 is provided on one side of cleaning solution storing section 711 to fill cleaning solution storing section 711 with a cleaning solution, such as DI water; and second nozzle 740 is provided proximate first nozzle 730 and within cleaning solution storing section 711 in such a way that the end tip portion of second nozzle 740 is positioned at a predetermined height.

A cleaning solution provided through first nozzle 730 fills to a certain level in cleaning solution storing section 711, and then the polishing face of diamond disk 6*a* pad conditioner 6 is lowered into the cleaning solution. At this time, air bubbles are generated from air bubble plate 720 to dislodge any foreign-substances adhering to the polishing face, particularly, solidified slurries. At the same time, a cleaning solution is sprayed via second nozzle 740 onto the upper surface of diamond disk 6*a* to remove and dislodge any foreign substances adhering to the upper section thereof.

However, in the conventional cleaning device 7, cleaning operation provided by second nozzle 740 is insufficient, thus even after the cleaning operation, foreign substances may remain on diamond disk 6*a*, which may damage a wafer being processed and thereby seriously lower the reliability of the semiconductor devices being formed on the wafer.

Accordingly, it is desirable to provide a conditioner cleaning apparatus for a chemical mechanical polishing pad capable of preventing scratches and damages on wafers caused by solidified slurries. It is also desirable to provide a conditioner cleaning apparatus capable of efficiently cleaning a diamond disk.

SUMMARY OF THE INVENTION

According to one aspect of the present invention, a conditioner cleaning device of a chemical mechanical polishing pad comprises a cup housing member, an air bubble plate member, a first cleaning solution supply unit, and a second cleaning solution supply unit.

The cup housing member is combined with a table, the table being provided with a plurality of polishing pads. The upper portion of the cup housing member has a cleaning solution storing section formed in the cup housing member to a determined depth and has a size acceptable for a diamond disk being lowered therein.

Also the air bubble plate member is located at the lower portion of the cleaning solution storing section of the cup housing member. The air bubble plate member has a diameter that is larger than that of the diamond disk, and which also has a plurality of air holes having a fine diameter. The air holes being formed on an upper face thereof.

In a related aspect, the first cleaning solution supply unit supplies cleaning solution to the cleaning solution storing section.

In yet another aspect, the second cleaning solution supply unit is connected to a main supply line, and is formed in a pipe shape and equipped to surround the diamond disk from the outside at a position higher than an upper face of the diamond disk. The diamond disk is positioned at a vertically upper portion of the air bubble plate member. Also the second cleaning solution supply unit is provided with a spraying pipe that is provided with a plurality of nozzle parts having spraying holes of a minute size formed on an inner face of the outer circumference.

BRIEF DESCRIPTION OF THE DRAWINGS

The present invention will become more fully understood from the detailed description given hereinbelow and the accompanying drawings which are given by way of illustration.

DETAILED DESCRIPTION OF THE INVENTION

Hereinafter, exemplary embodiments of the present invention will be described in detail with reference to FIGS. 4 through 6. It will be understood by those skilled in the art that the present invention can be embodied in numerous different ways and is not limited to the following described embodiments. The following various embodiments are exemplary in nature.

Figure 1:
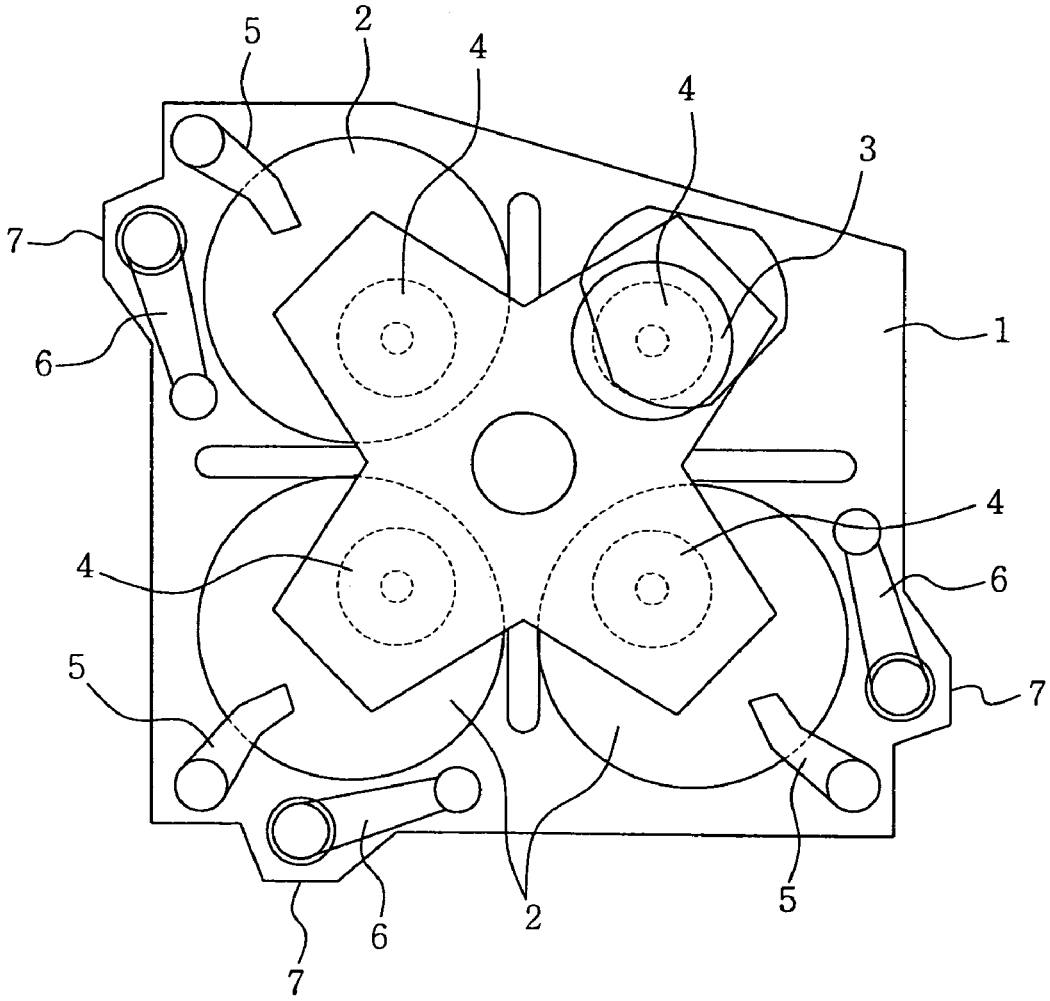
FIG. 1(PRIOR ART)
FIG. 1 is a plan view of a conventional polishing unit in a chemical mechanical polishing equipment.
Figure 2:
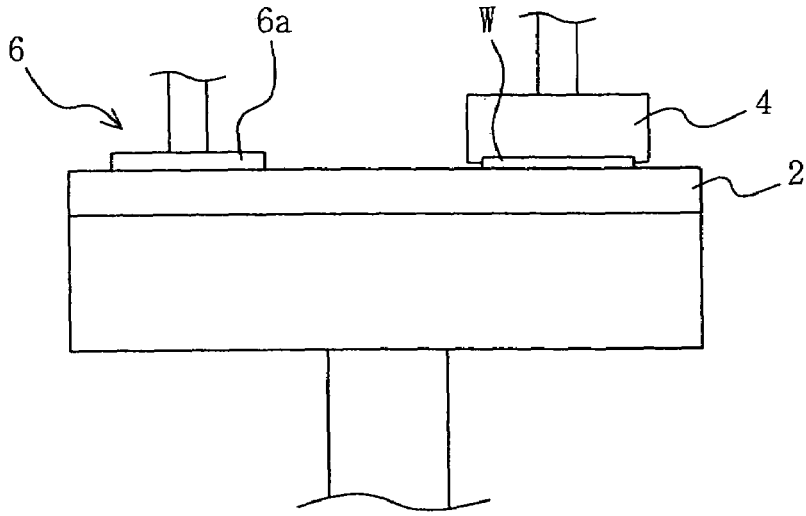
FIG. 2(PRIOR ART)
FIG. 2 is a side view illustrating the configuration of a polishing pad of FIG. 1.
Figure 3:
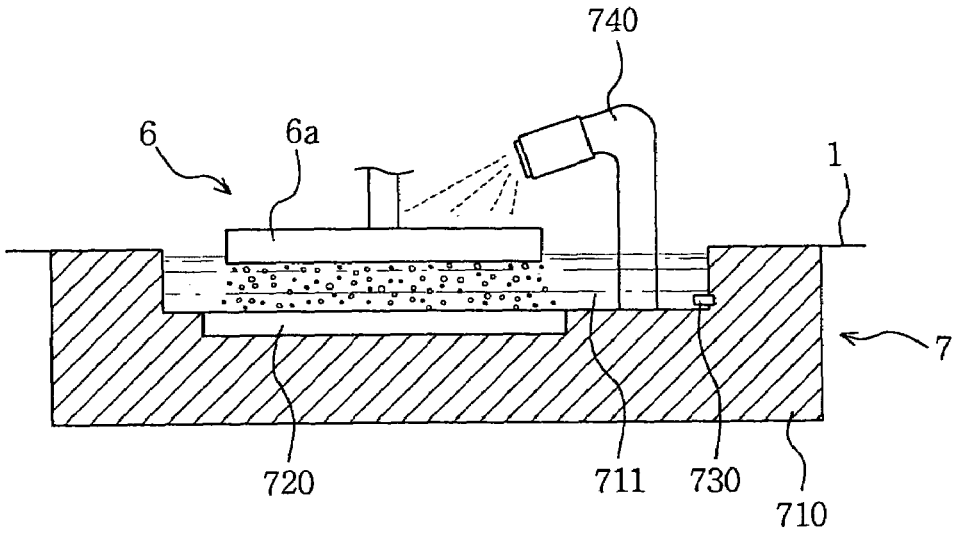
FIG. 3(PRIOR ART)
FIG. 3 is a sectional side view of the conventional conditioner cleaning apparatus.
Figure 4:
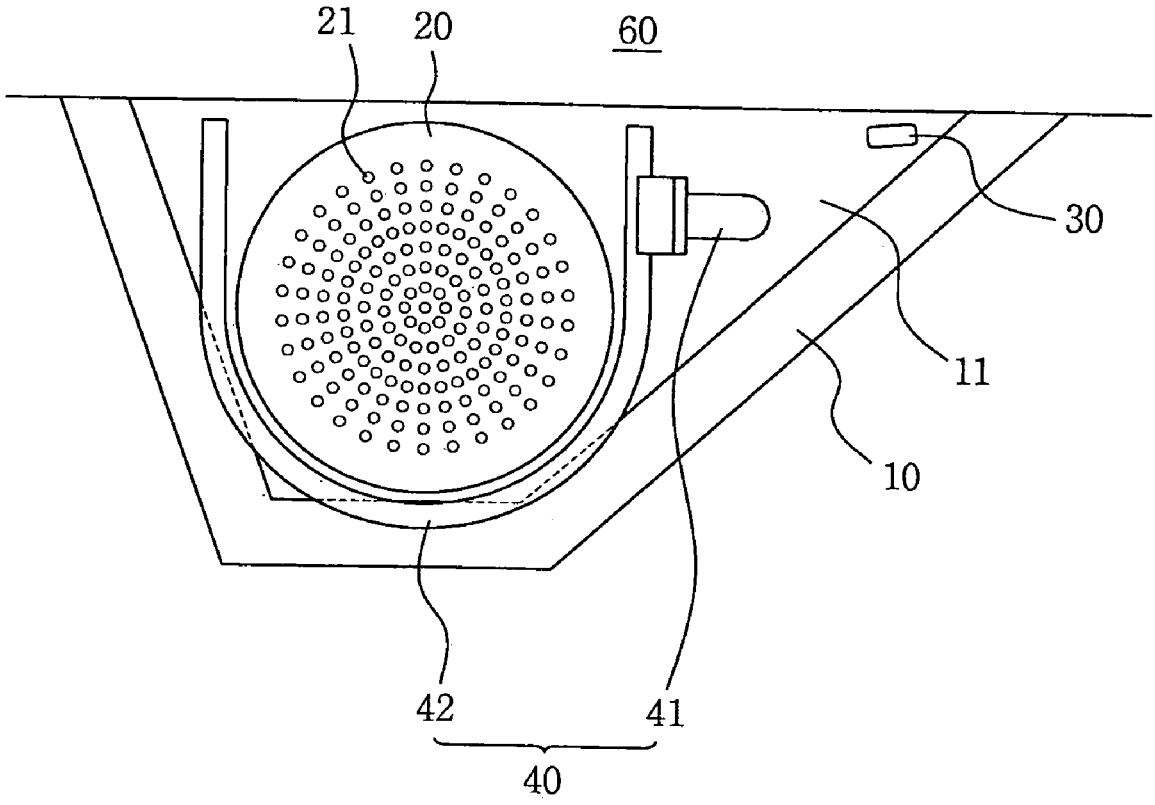
FIG. 4 is a plan view of a conditioner cleaning apparatus according to an exemplary embodiment of the present invention.

FIG. 4 is a plan view illustrating the configuration of a conditioner cleaning apparatus according to an exemplary embodiment of the present invention.

As shown in FIG. 4, the conditioner cleaning device having an improved configuration is adapted to be assembled with or disassembled from a table 60 in a polishing position.

In detail, the conditioner cleaning device of the present invention includes cup housing member 10, air bubble plate member 20, first cleaning solution supply unit 30, and second cleaning solution supply unit 40.

Cup housing member 10 is adapted to be combined with table 60, adjacent to each polishing pad (not shown). Table 60 is provided with a plurality of polishing pads that are provided at a predetermined interval therebetween. A portion of cup housing member 10 is recessed to a predetermined depth forming cleaning solution storing section 11. The cleaning solution storing section 11 is large enough to accommodate diamond disk 70. In particular, note in FIG. 4 that the cleaning solution storage section has a circular region dedicated to accommodate the diamond disk 70. See FIG. 5.

The height of cup housing member 10 should be equal or less than the height of table 60.

Air bubble plate member 20 is arranged at a bottom portion of cleaning solution storing section 11. The upper portion of air bubble plate member 20 has a plurality of air holes 21.

Air holes 21 generate bubbles into the cleaning solution. Air bubble plate member 20 is aligned in the same axis as the cleaning position of diamond disk of the pad conditioner, such that pad conditioner may be rotatably driven in a direction from table 60 to cup housing member 10.

First cleaning solution supply unit 30 is adapted to supply a cleaning solution into cleaning solution storing section 11.

Second cleaning solution supply unit 40 is provided at the upper portion of cup housing member 10 with a predetermined height.

Second cleaning solution supply unit 40 includes main supply pipe 41 and spraying pipe 42. Main supply pipe 41 is formed vertically and extends from the lower portion of cleaning solution storing section 11. Spraying pipe 42 is configured in such a way that one end thereof is connected to main supply pipe 41 to uniformly spray the cleaning solution onto the diamond disk.

Spraying pipe 42 has a shape which is capable of surrounding the diamond disk. See FIG. 4.

Figure 5:
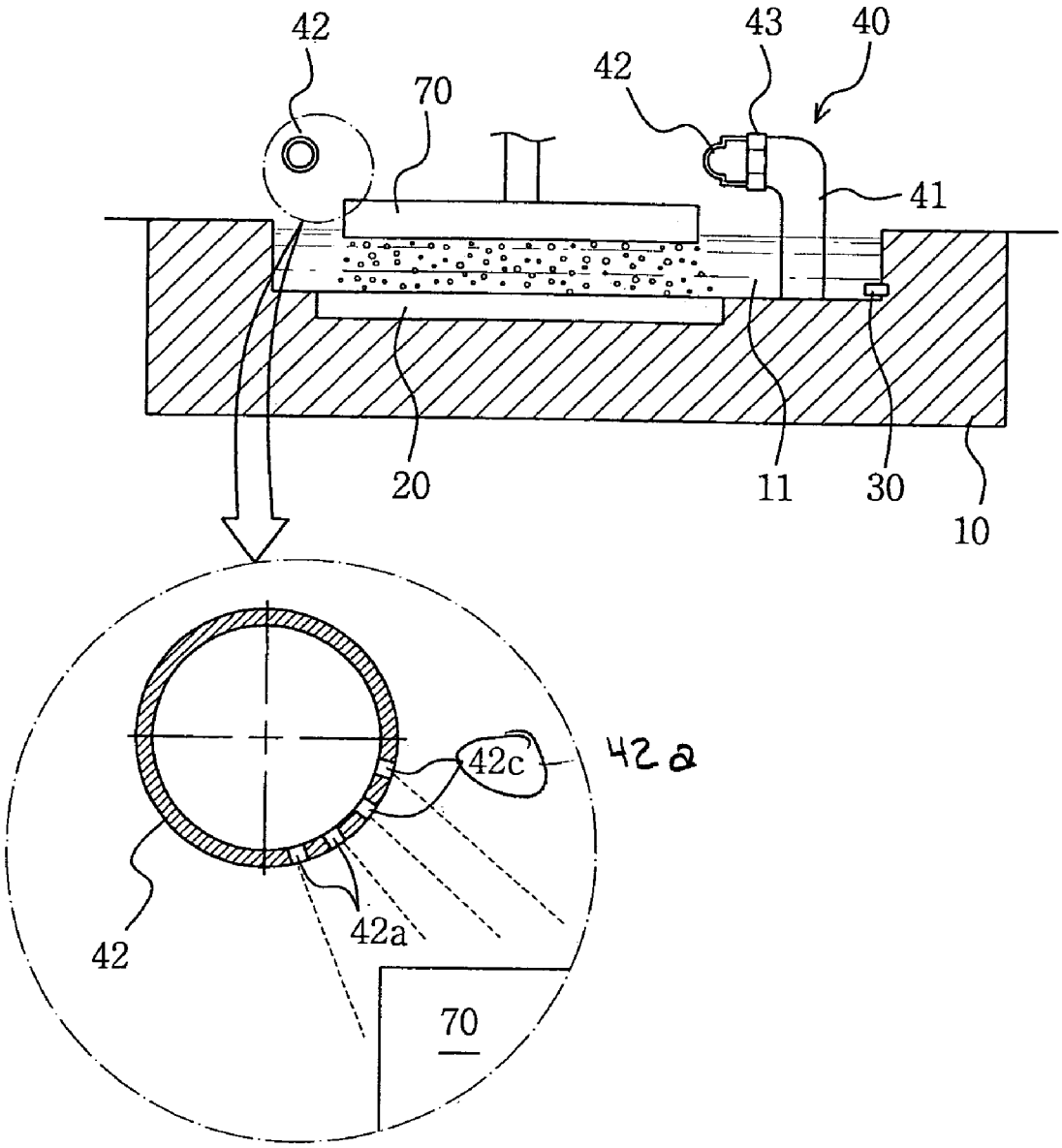
FIG. 5 is a sectional frontal view of a conditioner cleaning apparatus according to an exemplary embodiment of the present invention.

In particular, spraying pipe 42 is situated horizontally above the upper portion of diamond disk 70 when the diamond disk is in the cleaning position shown in FIG. 5. The inner lower portion of the spraying pipe 42 is provided with numerous nozzle parts (see FIG. 6) that are spaced a predetermined interval along the length of the pipe 42. Each nozzle part includes numerous minute spraying holes 42*a* extending radially through the pipe. The spraying holes 42*a* constituting each nozzle part are spaced from one another in the circumferential direction of the pipe 42 as shown in the enlarged section of FIG. 5. Thus, the spraying holes 42 of the pipe 42 are arrayed in both the circumferential and longitudinal directions of the pipe 42 and are thereby oriented to spray cleaning solution onto the upper and side surfaces of diamond disk 70.

The spraying pipe 42 has an arcuate section whose radius of curvature is greater than the radius of the circular region of the cleaning solution storing section 11 which accommodates the disk 70. Also, the spray pipe is disposed above such circular region as extending around at least a portion thereof.

More specifically, the spraying pipe 42 may be desirably formed as "U" shaped pipe that is opened in a movement direction of diamond disk 70 and has a width greater than the diameter of the diamond disk 70. Accordingly, the "U" shaped pipe 42 will not interfere with the movement of diamond disk 70 when diamond disk 70 is moved from its polishing position (over the polishing pad) to its cleaning position (over the upper side of air bubble plate member 20) by a rotation of the arm of the pad conditioner.

Spraying holes 42*a* of the nozzle part are formed to be directed toward the upper and side faces of diamond disk 70, and the nozzle parts are adapted so that sprayed sections of cleaning solution sprayed through the respective nozzle parts are minutely overlapped.

In second cleaning supply unit 40 the diameter of spraying pipe 42 may desirably smaller than an diameter of main supply pipe 41. Main supply pipe 41 and spraying pipe 42 are adapted to be tightly fastened to each other and separated therebetween through a specific fastening part such as nut 43.

Figure 6:
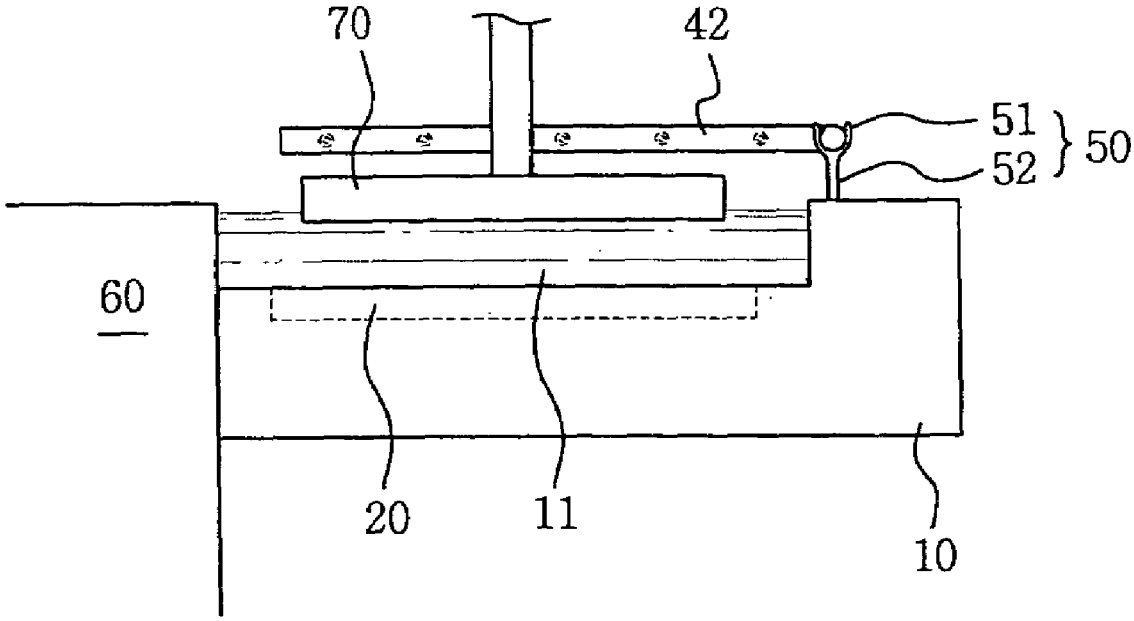
FIG. 6 is a sectional side view of a conditioner cleaning apparatus according to an exemplary embodiment of the present invention.

Spraying pipe 42 should be adapted to maintain a position higher than cup housing member 10, thus as shown in FIG. 6 it may be more desirable to also equip a support unit such as fixing holder 50 to support spraying pipe 42.

Fixing holder 50 may be further constructed of prop 51 and a support 52. Prop 51 is formed to prop and surround spraying pipe 42, and may be "U" shaped. Support 52 is downwardly extended from the middle portion of prop 51 and combined with an upper portion of cup housing member 10 so as not to be separated therefrom.

The configuration of the invention will be described in some additional detail as follows.

The present invention is characterized in one aspect in that the entire surface of the diamond disk can be fully and uniformly cleaned.

In the CMP apparatus, the wafer is mounted on the polishing pad, and polishing head and polishing pad are rotated in the same direction, and at the same time, slurry is supplied to polishing pad, such that the CMP is performed.

Polishing pad must maintain a certain friction with the wafer, thus pad conditioner is equipped to maintain polishing pad.

In pad conditioner one end thereof is shaft supported to table so as to be rotatable and ascendible/descendible at an outer side of polishing pad, and the another end thereof is provided with diamond disk to be positioned at one side of polishing pad and be contacted with a friction side of polishing pad.

Herewith, when pad conditioner rotates together with a rotation of polishing pad, diamond disk slides and moves along the friction side of polishing pad to uniformly polish the friction side.

A cleaning apparatus is provided to remove the slurries adhering on the diamond disk.

The cleaning device for cleaning diamond disk of pad conditioner is combined in one body with an outer side face of table positioned in a rotary radius of diamond disk of pad conditioner at an outer side of each polishing pad.

When diamond disk moves into position for cleaning, as shown in FIGS. 5 and 6 cleaning solution is filled into cleaning solution storing section 11 of cup housing member 10 through first cleaning solution supply unit 30, and then the lower portion of diamond disk 70 is lowered under the cleaning solution.

Spraying pipe 42 of second cleaning solution supply unit 40 is positioned higher than the upper portion of diamond disk 70 and is shaped so as to surround diamond disk. Cleaning solution is sprayed through spraying pipe 42 to uniformly and simultaneously clean the upper and side portions of diamond disk 70.

As afore-mentioned, particularly an inner diameter of spraying pipe interior through which the cleaning solution flows is formed smaller than that of main supply pipe 41 in second cleaning solution supply unit 40, such that a spraying pressure through the respective spraying holes 42*a* of spraying pipe 42 is increased, enhancing the spraying force.

The entire upper and side portions of diamond disk 70 are fully and uniformly cleaned by the cleaning solution sprayed through a nozzle portion, which is constructed of numerous spraying holes 42*a* strategically located along the outer circumference of spraying pipe 42, thereby fully removing slurries and various kinds of foreign substances adhering and stuck onto diamond disk 70, thus increasing the process reliability of wafers.

As described above, according to an exemplary embodiment of the invention, a cleaning solution spraying unit has an improved configuration to enable the uniform spraying of cleaning solution to the upper and side portions of diamond disk 70, when cleaning diamond disk 70.

It will be apparent to those skilled in the art that modifications and variations can be made in the present invention without deviating from the spirit or scope of the invention. Thus, it is intended that the present invention cover any such modifications and variations of this invention provided they come within the scope of the appended claims and their equivalents. Accordingly, these and other changes and modifications are seen to be within the true spirit and scope of the invention as defined by the appended claims.

What is claimed is:

1. A pad conditioner cleaning device, comprising:

a cup housing member having a recess that forms a cleaning solution storage section, a circular region of the cleaning solution storage section being dedicated to accommodate a disk of a pad conditioner of a chemical mechanical polishing apparatus;

a first cleaning solution supply unit mounted to the cup housing and oriented to supply cleaning solution into the cleaning solution storage section; and a second cleaning solution supply unit including a horizontal spray pipe having an arcuate section whose radius of curvature is greater than the radius of the circular region of the cleaning solution storage section, the spray pipe being disposed above the circular region as extending around at least a portion of the circular region, and the arcuate section of the spray pipe having a plurality of spray holes extending radially through a lower portion thereof, the spray holes being arrayed in both the circumferential and longitudinal directions of the spray pipe, wherein the spray holes are oriented to direct cleaning solution onto upper and side surfaces of the disk when the disk is set in the circular region of the cleaning section and cleaning solution is supplied through the spray pipe.

2. The pad conditioner cleaning device of claim 1, wherein said second cleaning solution supply unit includes a main supply pipe extending vertically from the cup housing member, the arcuate spray pipe being connected to the main supply pipe and having an inner diameter smaller than that of the main supply pipe.

3. The pad conditioner cleaning device of claim 1, and further comprising a support disposed on an upper portion of the cup housing member and supporting the spray pipe.

4. The pad conditioner cleaning device of claim 3, wherein the support comprises a U-shaped prop through which the spray pipe extends.

5. The pad conditioner cleaning device of claim 1, wherein the spray pipe is a U-shaped pipe.

6. The pad conditioner cleaning device of claim 1, and further comprising a plate having holes therethrough disposed at the bottom of the cleaning solution storage section to generate air bubbles in the cleaning solution supplied into the cleaning solution storage section.

7. A chemical mechanical polishing apparatus, comprising:

a table;

a polishing pad disposed on the table and supported so as to be rotatable relative to the table;

a polishing head disposed above the table and operative to hold a substrate to be polished against the polishing pad;

a pad conditioner including an arm, and an abrasive disk that conditions the polishing pad, the abrasive disk being mounted to an end of the arm; and a pad conditioner cleaning device including a cup housing member mounted to the table, the cup housing member having a recess that forms a cleaning solution storage section, a circular region of the cleaning solution storage section being dedicated to accommodate the disk of the pad conditioner, a first cleaning solution supply unit mounted to the cup housing and oriented to supply cleaning solution into the cleaning solution storage section, and a second cleaning solution supply unit including an spray pipe having an arcuate section whose radius of curvature is greater than the radius of the circular region of the cleaning solution storage section, the spray pipe being disposed above the circular region as extending around at least a portion of the circular region, and the arcuate section of the spray pipe having a plurality of spray holes extending radially though a lower portion thereof, the spray holes being arrayed in both the circumferential and longitudinal directions of the spray pipe, wherein the spray holes are oriented to direct cleaning solution onto upper and side surfaces of the disk of the pad conditioner when the disk is set in the circular region of the cleaning section and cleaning solution is supplied through the spray pipe.

8. The chemical mechanical polishing apparatus of claim 7, wherein the second cleaning solution supply unit of the pad conditioner cleaning device includes a main supply pipe extending vertically from the cup housing member, the arcuate spray pipe being connected to the main supply pipe and having an inner diameter smaller than that of the main supply pipe.

9. The chemical mechanical polishing apparatus of claim 7, wherein the pad conditioner cleaning device further includes a support disposed on an upper portion of the cup housing member and supporting the spray pipe.

10. The chemical mechanical polishing apparatus of claim 9, wherein the support comprises a U-shaped prop through which the spray pipe extends.

11. The chemical mechanical polishing apparatus of claim 7, wherein the spray pipe of the pad conditioner cleaning device is a U-shaped pipe.

12. The chemical mechanical polishing apparatus of claim 7, wherein the pad conditioner cleaning device further includes a plate having holes therethrough disposed at the bottom of the cleaning solution storage section to generate air bubbles in the cleaning solution supplied into the cleaning solution storage section.

13. A chemical mechanical polishing apparatus, comprising:

a table;

a polishing pad disposed on the table and supported so as to be rotatable relative to the table;

a polishing head disposed above the table and operative to hold a substrate to be polished against the polishing pad;

a pad conditioner mounted to the table at the side of the polishing pad, the pad conditioner including an arm, and an abrasive disk mounted to the arm, the arm being supported to move the disk between a conditioning position at which the disk is disposed over the polishing pad and a cleaning position at which the disk is disposed to the side of the polishing pad; and a pad conditioner cleaning device including a cup housing member mounted to the table, the cup housing member having a recess that forms a cleaning solution storage section at a location corresponding the cleaning position, a first cleaning solution supply unit mounted to the cup housing and oriented to supply cleaning solution into the cleaning solution storage section, and a second cleaning solution supply unit including a spray pipe that is U-shaped so as to have an opening at one side thereof, the width of the opening being greater than the diameter of the disk of the pad conditioner, the spray pipe being disposed above the cleaning solution storage section with the opening at said one side facing in the direction of movement of the disk such that the disk is positioned inwardly of the U-shaped pipe when the disk is moved to the cleaning position, and the U-shaped spray pipe having a plurality of nozzles spaced along the length thereof and oriented to direct cleaning solution onto upper and side surfaces of the disk of the pad conditioner when the disk is set at the cleaning position and cleaning solution is supplied though the U-shaped spray pipe.

14. The chemical mechanical polishing apparatus of claim 13, wherein the U-shaped spray pipe of the pad conditioner cleaning device has a plurality of spray holes extending radially though a lower portion thereof, respective groups of the spray holes constituting the nozzles.

15. The chemical mechanical polishing apparatus of claim 14, wherein the spray holes are arrayed in both the circumferential and longitudinal directions of the U-shaped spray pipe.

16. The chemical mechanical polishing apparatus of claim 13, wherein the second cleaning solution supply unit of the pad conditioner cleaning device includes a main supply pipe extending vertically from the cup housing member, the U-shaped spray pipe being connected to the main supply pipe and having an inner diameter smaller than that of the main supply pipe.

17. The chemical mechanical polishing apparatus of claim 13, wherein the pad conditioner cleaning device further includes a support disposed on an upper portion of the cup housing member and supporting the U-shaped spray pipe.

18. The chemical mechanical polishing apparatus of claim 17, wherein the support comprises a U-shaped prop through which the spray pipe extends.

19. The chemical mechanical polishing apparatus of claim 13, wherein the pad conditioner spray device further includes a plate having holes therethrough disposed at the bottom of the cleaning solution storage section to generate air bubbles in the cleaning solution supplied into the cleaning solution storage section.

* * * * *